US005630523A

United States Patent [19]

Wright

[11] Patent Number: 5,630,523

[45] Date of Patent: May 20, 1997

[54] INTERCONNECTED FLUID CONTAINERS

[75] Inventor: Earl K. Wright, Chariton, Iowa

[73] Assignee: Novotrend Ventures, Inc., Aurora, Colo.

[21] Appl. No.: 425,660

[22] Filed: Apr. 20, 1995

[51] Int. Cl.[6] ..... B65D 23/00

[52] U.S. Cl. ..... 220/23.83; 220/4.27; 215/6

[58] Field of Search ..... 220/4.27, 23.4, 220/23.83; 215/6, 10

[56] References Cited

U.S. PATENT DOCUMENTS

| | | | |
|---|---|---|---|
| 178,818 | 6/1876 | Warner . | |
| 559,697 | 5/1896 | Gallagher . | |
| 748,329 | 12/1903 | Williamson . | |
| 821,579 | 5/1906 | Austen . | |
| 1,801,281 | 4/1931 | McEldowney | 220/23.83 X |
| 2,110,237 | 3/1938 | Parsons | 215/6 X |
| 3,369,687 | 2/1968 | Walls | 215/10 |
| 3,371,807 | 3/1968 | Clouser et al. . | |
| 3,485,416 | 12/1969 | Fohrman | 220/4.27 X |
| 4,444,324 | 4/1984 | Grenell . | |
| 4,603,784 | 8/1986 | Chang | 215/6 X |
| 5,165,546 | 11/1992 | Jaeger et al. | 215/6 X |

*Primary Examiner*—Steven M. Pollard

*Attorney, Agent, or Firm*—Zarley, McKee, Thomte, Voorhees, & Sease

[57] ABSTRACT

Two separate containers are secured together by their respective bottoms. One container has a cavity in its bottom which has an annular frictional shoulder. The other container has a protruding shoulder on its bottom comparable in size to the cavity on the other container. That shoulder has an annular recess therein adapted to engage frictionally the annular shoulder in the other container. The cavity in the one container and the protruding shoulder on the other are of oval shape.

5 Claims, 2 Drawing Sheets

INTERCONNECTED FLUID CONTAINERS

BACKGROUND OF THE INVENTION

It is often desirable to have containers which have separate related fluids therein interconnected for convenience purposes particularly when the contents of the containers are used at substantially the same time. For example, a container having shampoo therein is normally used in conjunction with a separate container having hair conditioner therein.

It is not new to have separate but related containers secured together for convenience purposes. However, existing devices which have this structural arrangement are either difficult to connect together or difficult to separate from each other. Further, such existing containers are often unattractive by reason of the connecting mechanism. Further, they have no structural arrangement whereby they can be reconnected in exactly the same orientation as they were before they were separated.

It is therefore a principal object of this invention to provide a combination of two separate containers which are secured together by their respective bottoms.

It is a further object of this invention to provide interconnected containers which can be easily connected together and easily separated without using a separate connecting structure.

A still further object of this invention is to provide interconnected containers which can stand easily on a flat supporting surface regardless of which container is in an upper position and which container is in a lower position.

These and other objects will be apparent to those skilled in the art.

SUMMARY OF THE INVENTION

Two separate containers are secured together by their respective bottoms. One container has a cavity in its bottom which has an annular frictional shoulder. The other container has a protruding shoulder on its bottom comparable in size to the cavity on the other container. That shoulder has an annular recess therein adapted to engage frictionally the annular shoulder in the other container. The cavity in the one container and the protruding shoulder on the other are of oval shape.

DESCRIPTION OF THE PREFERRED EMBODIMENT

Figure 1:
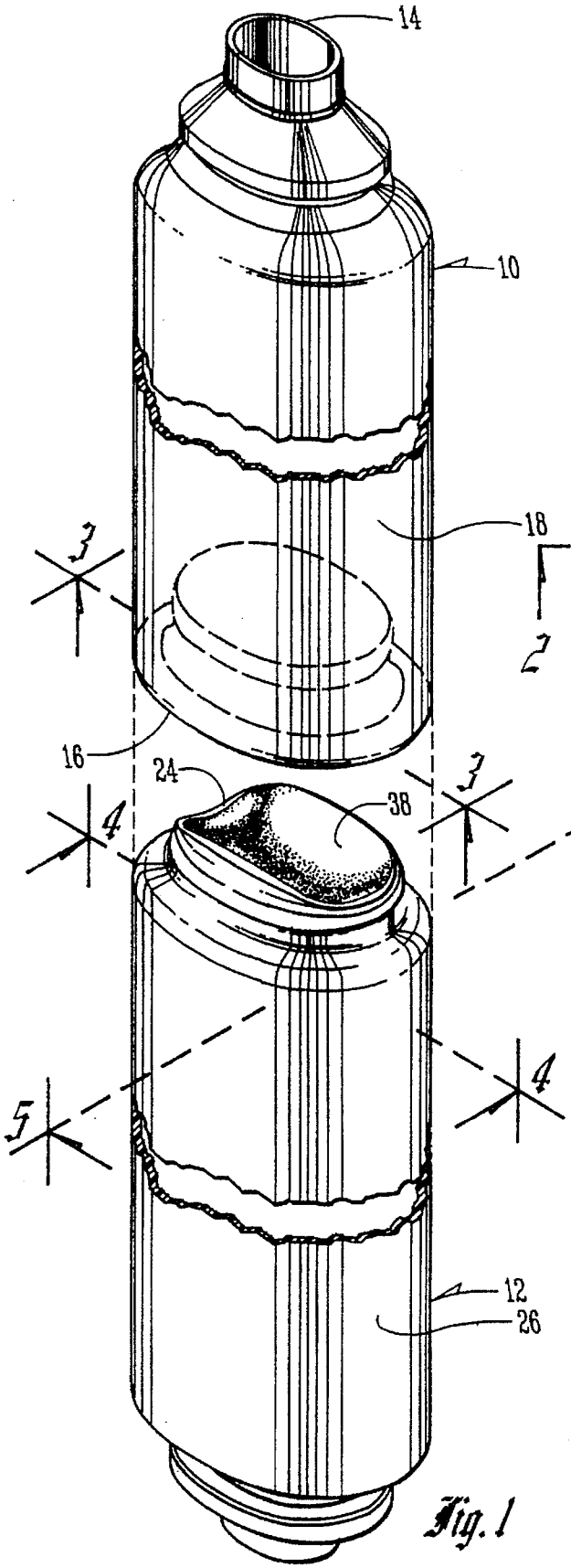
FIG. 1 is an exploded view showing two containers vertically disposed and about to be connected.

The numeral 10 designates the "upper" container and the numeral 12 designates a "lower" container. Container 10 has a flat top 14, a bottom 16, a side wall 18 and an inner compartment 20.

Bottom container 12 also has a flat top 12 and a bottom 24. It should be understood that the terms "top" and "bottom" as used to describe container 12 are used since in fact the container 12 is turned upside down, as shown in the drawings, when it is connected to container 10. Thus, the terms "top" and "bottom" with reference to container 12 refer to these components when container 12 is in its upright condition.

Container 12 also includes side wall 26 and an inner compartment 28.

Figure 2:
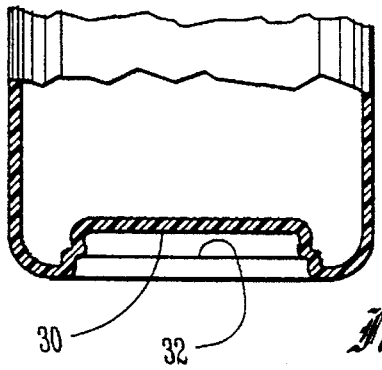
FIG. 2 is a partial sectional view of the bottom portion of the upper container taken on line 2—2 of FIG. 3.
Figure 3:
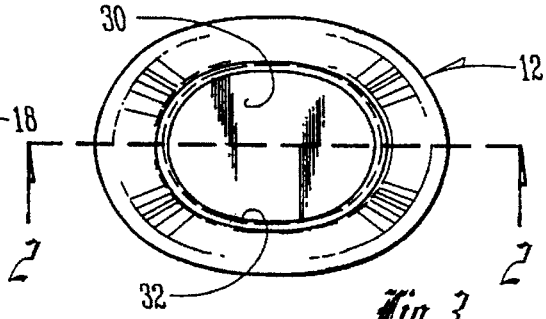
FIG. 3 is a bottom plan view of the upper container.
Figure 4:
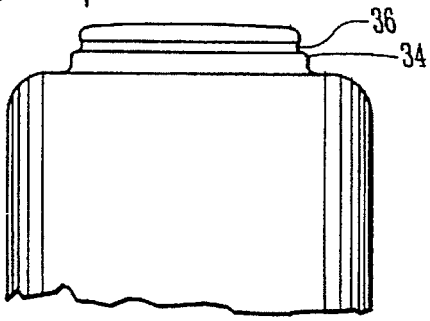
FIG. 4 is a front elevational view of the upper portion of the lower container taken on line 4—4 of FIG. 1.
Figure 5:
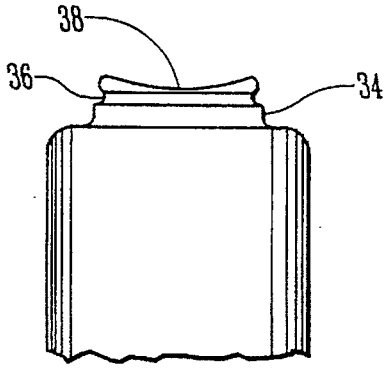
FIG. 5 is a view taken at right angles to the view of FIG. 4; and specifically as taken on line 5—5 of FIG. 1.
Figure 6:
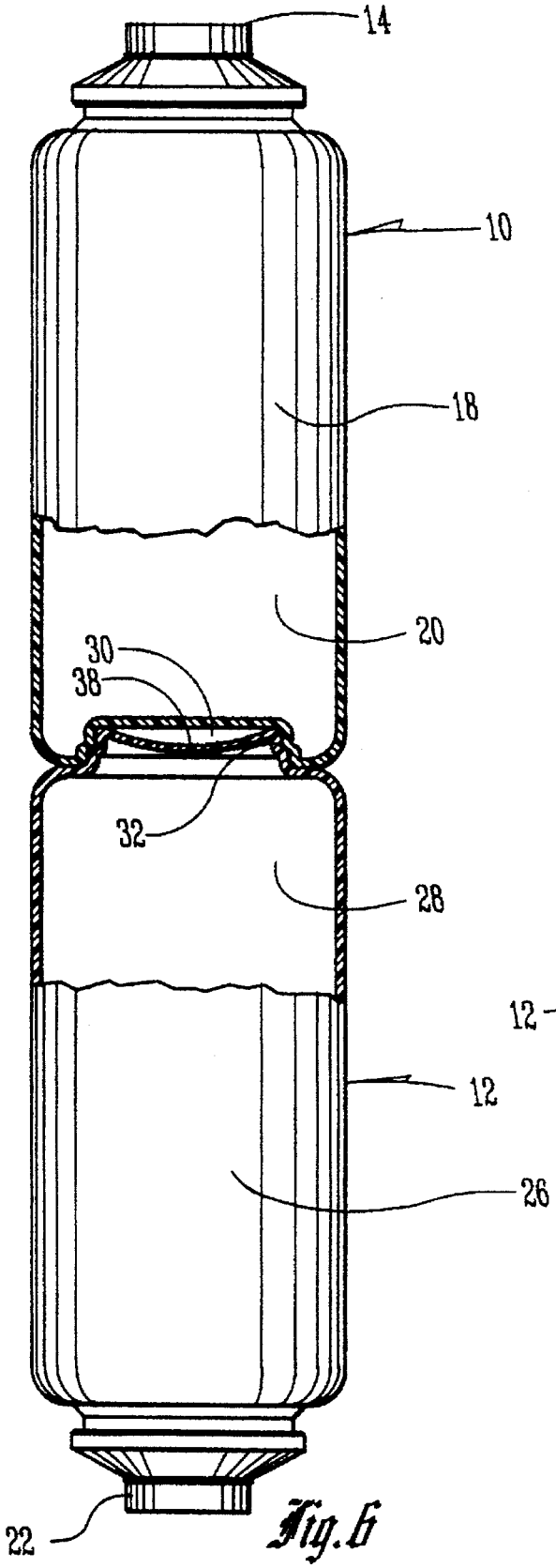
FIG. 6 is a front elevational view of the two containers secured together with portions thereof cut away to more fully illustrate the interconnecting structure.
Figure 7:
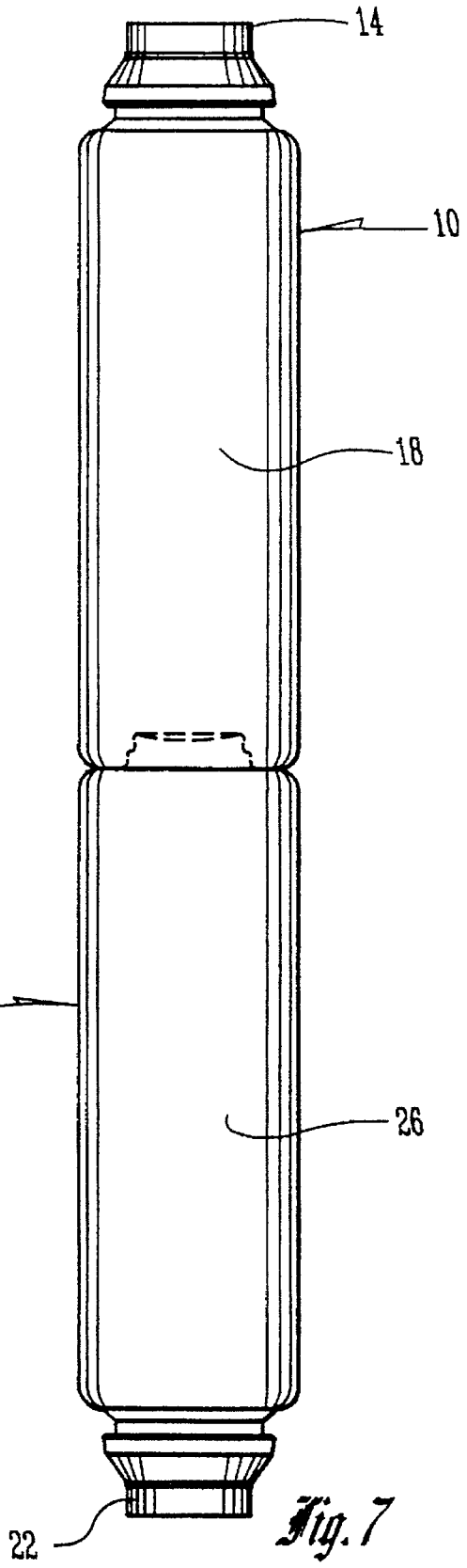
FIG. 7 is a side elevational view of the device of FIG. 6 without any of the side walls being cut away.

With reference to FIG. 2, the bottom 16 of container 10 has an oval shaped cavity 30 therein with an annular friction shoulder 32 extending therearound. The top 22 of container 12 has an oval shaped shoulder 34 which includes an annular recess 36 and a concave surface 38 (FIGS. 1 and 6). The concave surface 38 gives the shoulder 38 some resiliency.

When it is desired to join the containers 10 and 12 as shown in FIG. 1, the shoulder 34 on container 12 is inserted into the cavity 30 of container 10 so that the friction shoulder 32 within cavity 30 snaps into the annular recess 36 on shoulder 34 of container 12. As previously indicated, the flexibility of the concave surface 38 facilitates the slight deflection of shoulder 34 to permit the friction shoulder 32 within the cavity 30 to snap into the annular recess 36 on the shoulder 34 of container 12.

Since the shoulder 34 is oval shaped as is the cavity 30, the containers 10 and 12 are oriented in the same way each time they are connected or disassembled. To disassemble the two containers, the container 10 is forcibly tilted with respect to the container 12 so that the friction shoulder 32 disengages itself from the annular recess 36. While the containers 10 and 12 normally have pictorial or other matter on one side or the other, except for the possibility of being reversed 180°, the orientation of the two containers will always be the same since the oval configuration of shoulder 34 and cavity 30 prevents the two containers from being placed together in an infinite number of ways.

It is therefore seen that the device of this invention will achieve at least all of its stated objectives.

What is claimed is:

1. The combination of two separate containers containing separate contents secured together, comprising, a first container having a top, a bottom, and a continuous side wall, a second container having a top, a bottom, and a continuous side wall, one of said containers having a cavity in the bottom thereof, the other of said containers having a protruding portion thereon, said containers being secured together at their respective bottoms by having said protruding portion on the bottom of one container frictionally and detachably held within the cavity on the bottom of said other container, said cavity and said protruding portion being oval in shape and being non-rotatable with respect to each other when assembled together to prevent said containers from being assembled together in an infinite number of different orientations.

2. The combination of claim 1 wherein the size and shape of said containers except for said cavity and said protruding portion are substantially the same.

3. The combination of claim 1 wherein said container has a friction shoulder therein in frictional engagement with an annular recess on said protruding portion.

4. The combination of claim 3 wherein said protruding portion has a resilient surface thereon to facilitate the flexing of said annular groove for engagement and disengagement with said friction shoulder.

5. The combination of claim 4 wherein said surface has a concave shape.

* * * * *